US006513656B2

(12) United States Patent
Hanaoka et al.

(10) Patent No.: US 6,513,656 B2
(45) Date of Patent: Feb. 4, 2003

(54) SHRINK-WRAPPED PACKAGE

(75) Inventors: Yuji Hanaoka, Moriyama (JP); Fusazo Wada, Moriyama (JP); Mina Okamoto, Chuo-ku (JP)

(73) Assignee: Gunze Limited, Kyoto (JP)

( * ) Notice: Subject to any disclaimer, the term of this patent is extended or adjusted under 35 U.S.C. 154(b) by 0 days.

(21) Appl. No.: 09/446,544

(22) PCT Filed: Apr. 26, 1999

(86) PCT No.: PCT/JP99/02214

§ 371 (c)(1),
(2), (4) Date: Dec. 22, 1999

(87) PCT Pub. No.: WO99/55595

PCT Pub. Date: Nov. 4, 1999

(65) Prior Publication Data

US 2002/0179479 A1 Dec. 5, 2002

(30) Foreign Application Priority Data

Apr. 28, 1998 (JP) ..... 10-156557

(51) Int. Cl.[7] ..... B65D 71/08

(52) U.S. Cl. ..... 206/497; 156/251; 156/275.1; 206/705

(58) Field of Search ..... 156/251, 275.1; 53/442, 463; 206/497, 705; 428/910; 493/199, 203

(56) References Cited

U.S. PATENT DOCUMENTS

| | | | | | |
|---|---|---|---|---|---|
| 3,574,046 | A | * | 4/1971 | Buteux | 428/910 |
| 3,695,426 | A | * | 10/1972 | Engelsberger | 206/497 |
| 3,736,219 | A | * | 5/1973 | McTaggart | 383/107 |
| 3,889,870 | A | * | 6/1975 | Bender | 206/497 |
| 3,912,575 | A | * | 10/1975 | Zelnick | 493/203 |
| 3,969,176 | A | * | 7/1976 | Bassett et al. | 156/251 |
| 3,994,209 | A | * | 11/1976 | Jacob | 493/203 |
| 4,116,116 | A | * | 9/1978 | Barnett | 493/199 |
| 4,250,796 | A | * | 2/1981 | Achelpohl et al. | 493/203 |
| 4,285,681 | A | * | 8/1981 | Walitalo et al. | 493/203 |
| 4,433,527 | A | * | 2/1984 | Ramsey et al. | 493/203 |
| 4,931,034 | A | * | 6/1990 | Wagner | 493/203 |
| 5,059,470 | A | * | 10/1991 | Fukuda et al. | 428/142 |
| 5,074,951 | A | * | 12/1991 | Banco et al. | 493/199 |
| 5,756,032 | A | * | 5/1998 | Lee et al. | 428/357 |
| 5,797,247 | A | * | 8/1998 | Nakagoshi et al. | 53/442 |
| 5,910,356 | A | * | 6/1999 | Ishikawa et al. | 428/215 |

FOREIGN PATENT DOCUMENTS

| | | |
|---|---|---|
| EP | 0409288 | 1/1991 |
| GB | 969584 | 9/1964 |
| JP | 4279339 | 5/1992 |
| JP | 8192464 | 7/1996 |

* cited by examiner

*Primary Examiner*—Jim Foster
(74) *Attorney, Agent, or Firm*—Baker Botts L.L.P.

(57) ABSTRACT

The present invention provides a shrink-wrapped package comprising at least one article shrink-wrapped with a polyester film containing an ethylene terephthalate unit, the shrink-wrapped package having a portion of sealing and cutting whose starting point has a movement distance of 10 μm or less.

6 Claims, 2 Drawing Sheets

(a)

SHRINK-WRAPPED PACKAGE

TECHNICAL FIELD

The present invention relates to a shrink-wrapped package prepared using a polyester film containing an ethylene terephthalate unit, the shrink-wrapped package having a portion of sealing and cutting (fusion sealing and cutting) which has an excellent impact resistance. The present invention also relates to a process for shrink-wrapping an article or articles with said polyester film.

BACKGROUND ART

Films for shrink wrapping, especially those for shrink-wrapping a stack of articles, are required to be free from wrinkles or blots after shrinkage, capable of tightly uniting the articles, and excellent in impact resistance at the portion of sealing and cutting. Conventionally, shrinkable films of polyvinyl chloride or polyolefin are widely utilized.

Although shrinkable films of polyvinyl chloride have excellent shrinking properties and satisfactory impact resistance at the portion of sealing and cutting, they have hygienic problems owing to plasticizers, heat stabilizers and processing aids contained therein, and problems with thermal disposal because they contain chlorine. Further, heat shrinkable films of polyolefin are excellent in impact resistance at the portion of sealing and cutting and free from problems with thermal disposal, but they need to be shrunk at a high temperature in order to obtain good finish. Moreover, films of polyolefin are likely to loosen after shrinkage and thus difficult to tightly unite articles. Also, they are limp and unsatisfactory in transparency.

Shrinkable films of polyester have stiffness, good transparency, excellent shrinking properties and capability of tightly uniting articles, and are free from problems with thermal disposal. The only disadvantage of the polyester films is that they have a poor impact resistance at the portion of sealing and cutting.

Japanese Examined Patent Publication No. 29139/1989 discloses a technique for improving the impact resistance of a sealed portion. This technique utilizes as a packaging material a heat shrinkable polyester film having a thermal shrinkage percentage of at least 10% in each of the machine and transverse directions, as measured after dipping in hot water at 100° C. The heat shrinkable polyester film is prepared by orientating a polyester sheet at least 2.5 times in each of the machine and transverse directions and thermally relaxing the orientated sheet by 5 to 30% in at least one direction. The film is provided with a sealed portion having an impact strength of at least 10 kg-cm to package articles, and then thermally shrunk.

In this technique, however, the sealing method is limited to impulse heat sealing. Moreover, although the publication states that the film can be heat sealed when a thermal adhesive resin is applied to the film, the disclosed film, when subjected to sealing and cutting, has a low impact resistance at the portion of sealing and cutting, and thus cannot be put into practical use.

When a stack of articles is to be shrink-wrapped, generally employed is sealing and cutting using ultrasonic waves, high frequency or nichrome wire. This is because sealing and cutting enables continuous sealing, thus increasing the processing speed, and produces substantially no overlapping sealed portion so that the resulting packages have good appearance and a pile of the packages is unlikely to collapse even if the articles wrapped in the packages are of light weight.

In contrast, impulse heat sealing or heat sealing is conducted intermittently and thus slow in processing speed. Further, overlapping sealed portions with a width of 5 to 20 mm are usually produced, so that the resulting packages have poor appearance and a pile of the packages is liable to lean and collapse when the articles wrapped in the packages are of light weight.

An object of the present invention is to provide a shrink-wrapped package which is prepared using a polyester film and which has a portion of sealing and cutting having an excellent impact resistance.

BRIEF DESCRIPTION OF DRAWINGS

FIG. 1(*b*) is a sectional view of a film ruptured by an impact upon a portion of sealing and cutting. FIG. 1(*c*) is a sectional view of an incompletely sealed area as opened.

DISCLOSURE OF THE INVENTION

Figure 1:
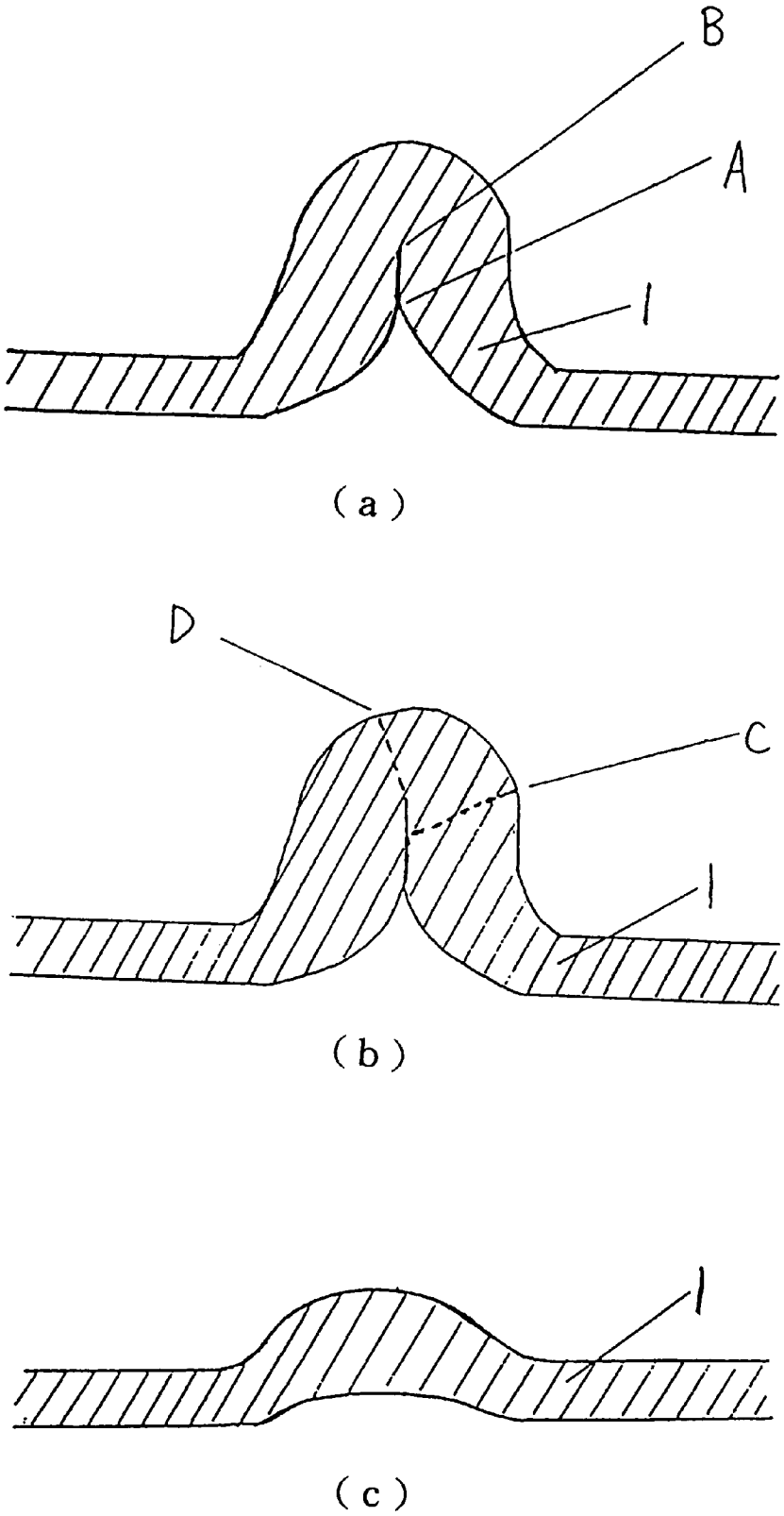
FIG. 1(*a*) is a sectional view of an incompletely sealed area in a portion of sealing and cutting.

The present invention provides a shrink-wrapped package comprising at least one article shrink-wrapped with a polyester film containing an ethylene terephthalate unit, the shrink-wrapped package having a portion of sealing and cutting whose starting point has a movement distance of 10 $\mu$m or less.

The present invention will be described below in detail.

The polyester film containing an ethylene terephthalate unit for use in the present invention is a film prepared from a polyester resin containing an ethylene terephthalate unit which comprises a terephthalic acid or its derivative as an acid component and ethylene glycol as an glycol component.

Examples of terephthalic acid derivatives include dimethyl terephthalate, diethyl terephthalate and other terephthalates.

Also usable as the polyester resin in the present invention are polyester resins prepared by copolymerizing, together with terephthalic acid or its derivative and ethylene glycol, at least one acid component selected from dicarboxylic acids other than terephthalic acid and its derivatives, such as phthalic acid, isophthalic acid, naphthalenedicarboxlic acid, diphenyldicarboxylic acid and like aromatic dicarboxylic acids, oxalic acid, malonic acid, succinic acid, adipic acid, azelaic acid, sebacic acid and like aliphatic dicarboxylic acids, and their derivatives; and at least one diol component selected from diols other than ethylene glycol, such as propylene glycol, butane diol, neopentyl glycol, hexamethylene glycol and like aliphatic glycols, 1,4-cyclohexanedimethanol and like alicyclic diols, xylylene glycol, hydroquinone and like aromatic diols, diethylene glycol, and their substitution products. The polyester resins can be used singly or in combination.

In the polyester resin as the resin component of the polyester film for use in the invention, terephthalic acid or its derivative as the acid component accounts for at least 60 mol %, preferably at least 70 mol %, more preferably at least 80 mol %.

Ethylene glycol as the diol component in said polyester resin accounts for at least 50 mol %, preferably at least 60 mol %, more preferably at least 65 mol %.

Preferred polyester resins include those comprising terephthalic acid as a dicarboxylic acid component, and as diol components ethylene glycol and cyclohexane dimethanol and/or neopentyl glycol and/or diethylene glycol, and polyethylene terephthalate and/or polybutylene terephthalate.

The polyester resin has an intrinsic viscosity of at least 0.5 g/dl, preferably at least 0.6 g/dl, more preferably at least 0.7 g/dl. The upper limit of the intrinsic viscosity is up to 1.5 g/dl, preferably up to 1.4 g/dl, more preferably up to 1.3 g/dl. When the polyester resin has an intrinsic viscosity of 0.5 to 1.5 g/dl, the resulting film has a sufficient strength and a desired impact strength at the portion of sealing and cutting.

It is preferable to add inorganic and/or organic fine particles to the polyester resin in order to improve lubricity of the film and thereby render the film amenable to high-speed automatic processing. Usable fine particles are not limited and include, for example, known fine particles of silica, calcium carbonate, polymethyl acrylate (PMA) and polymethyl methacrylate (PMMA).

The average particle diameter of the fine particles is 6 to 0.5 $\mu$m, preferably 5 to 0.5 $\mu$m, more preferably 4 to 1 $\mu$m. Fine particles with an average particle diameter of 0.5 $\mu$m to 6 $\mu$m, when added, achieve an excellent impact resistance at the portion of sealing and cutting, and impart sufficient lubricity to the film.

The fine particles are added to the polyester resin in a proportion of about 3000 to 200 ppm, preferably about 1500 to 300 ppm, more preferably about 1000 to 400 ppm. About 3000 to 200 ppm of the fine particles, when added, achieves an excellent impact resistance at the portion of sealing and cutting, and imparts sufficient lubricity to the film.

The film obtained using such fine particles has a static friction coefficient ($\mu$s) of about 0.1 to 0.6 and a dynamic friction coefficient ($\mu$d) of about 0.1 to 0.5, and is amenable to high-speed automatic processing.

Where necessary, stabilizers, processing aids, colorants, antioxidants, UV absorbers, antistatic agents or other resins may be incorporated into the polyester resin or applied to the film.

The film for use in the present invention can be prepared by known methods for preparing shrinkable films. Examples of such methods include one comprising extruding a resin from a cylindrical die to form a tubular film, biaxially orientating the tubular film simultaneously about 1.2 to 8 times in the machine direction and about 1.2 to 8 times in the transverse direction, and where necessary, annealing the orientated film; and one comprising extruding a resin from a T die to form a flat film, biaxially orientating the flat film either simultaneously or sequentially about 1.2 to 8 times in the machine direction and about 1.2 to 8 times in the transverse direction, and where necessary, annealing the orientated film.

The thickness of the film is not limited, but is usually about 5 to 100 $\mu$m, preferably about 10 to 30 $\mu$m.

The shrinkage percentage of the film depends on the required amount of shrinkage (i.e., margin), and is usually at least 5% in each of the machine and transverse directions as measured after dipping in hot water at 70° C. for 30 seconds, and at least 10% in each of the machine and transverse directions as measured after dipping in hot water at 80° C. for 30 seconds.

Next, the movement distance of the starting point of the portion of sealing and cutting will be described. The starting point of the portion of sealing and cutting is indicated as A in FIG. 1(*a*). The movement distance is measured as follows: A 2 mm wide strip perpendicular to the seal and cut line is cut out from a shrink-wrapped package, and a microphotograph of the cross section of the portion of sealing and cutting is taken at 500×magnification (Photograph 1). Then, the strip is set on a tensile tester (Strograph) at a chuck distance of 5 cm, so that the portion of sealing and cutting is positioned at the center of the tensile tester. The strip is pulled at a rate of 50 mm/min, and pulling is stopped at the time of exceeding the yield point. Then, the strip was removed from the tester. A microphotograph of the cross section of the portion of sealing and cutting is taken in the same manner as above (Photograph 2). Subsequently, the movement distance of the starting point of the portion of sealing and cutting is found from Photographs 1 and 2, by measuring the distance between the starting point of the portion of sealing and cutting and a spot serving as a mark, such as a small ball formed by sealing, projection, depression, fine particle or foreign matter in the sealed portion shown in each of Photographs 1 and 2. (When the portion of sealing and cutting has a cross section as shown in FIG. 2, the movement distance of the starting point E or F can be measured in the same manner as above.)

Figure 2:
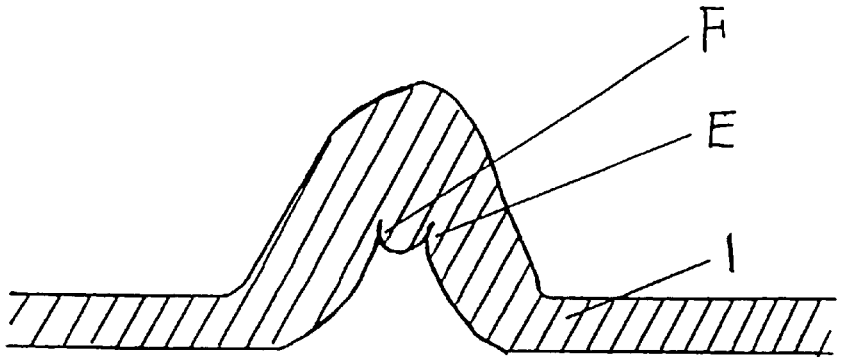
FIG. 2 is a sectional view of a portion of sealing and cutting having a different shape.

When a polyester film is subjected to sealing and cutting, an incompletely sealed area extending from A to B is formed as shown in FIG. 1(*a*). The strength of sealing is expressed as a tensile strength measured at a constant rate of traverse or a constant rate of extension (according to, for example, ASTM D 822-64T, JIS K 6732 or JIS K 6734). Since the rate of traverse or extension is usually as low as 50 to 500 mm/min, the incompletely sealed area opens during measurement and finally reaches the state as shown in FIG. 1(*c*), increasing the tensile strength.

However, when an instantaneous impact is given to the portion of sealing and cutting, the incompletely sealed area does not fully open so that the total impact energy concentrates at the sealed portion. In addition, polyester films have low tearing strength. Accordingly, the film ruptures as indicated by the broken line C or D in FIG. 1(*b*), resulting in a low impact strength.

The polyester film used in the present invention, even when subjected to an instantaneous impact, is free from rupture as shown in FIG. 1(*b*) and reaches the state shown in FIG. 1(*c*) to absorb the impact energy. In the present invention, since the starting point of the portion of sealing and cutting has a movement distance of about 10 $\mu$m or less, the portion of sealing and cutting readily reaches the state shown in FIG. 1(*c*). The movement distance of the starting point is usually 10 $\mu$m or less, preferably 9 $\mu$m or less, more preferably 8 $\mu$m or less.

If the movement distance is over 10 $\mu$m, the portion of sealing and cutting ruptures as show in FIG. 1 (*b*), failing to provide a shrink-wrapped package having a portion of sealing and cutting with an excellent impact resistance.

Figure 3:
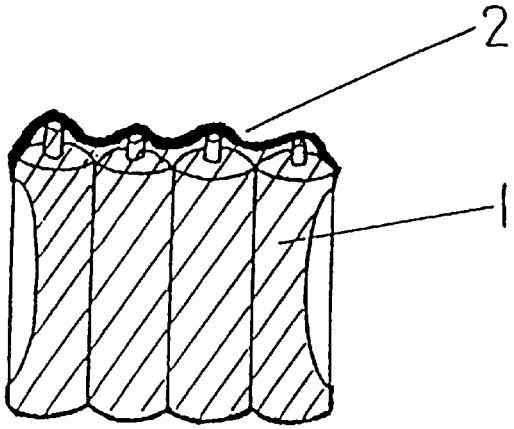
FIG. 3 is a perspective view of a shrink-wrapped package of dry batteries having a portion of sealing and cutting at the positive terminal side.

In some cases, the movement distance of the starting point of the portion of sealing and cutting falls within the above specified range as a natural result of the shrinkage stress of the film produced at the time of shrink wrapping, depending on the relation between the shape of the article to be wrapped and the position of the portion of sealing and cutting. For example, the movement distance of the starting point will fall within the specified range when articles having a depression, such as videocassettes or hardcover books, are shrink-wrapped by sealing and cutting at the position of the depression, or when the portion of sealing and cutting is provided at the positive terminal side of dry batteries, as shown in FIG. 3.

Except for such special cases, the movement distance is adjusted to the above specified range by suitable methods, without limitation. Preferably, after sealing and cutting, the portion of sealing and cutting is physically stretched in the direction perpendicular to the seal and cut line at a tension sufficient to open the incompletely sealed area (usually not lower than 500 g/mm$^2$ but lower than the strength of sealing), followed by shrink-wrapping. Alternatively, after sealing and cutting and shrink-wrapping, the vicinity of the portion of sealing and cutting is heated at a high temperature to stretch the portion of sealing and cutting by the shrinkage stress of the film produced by heating. Alternatively, at the time of sealing and cutting, the portion to be sealed is pressed to completely seal said portion, i.e., not to form an incompletely sealed area.

Articles to be wrapped according to the present invention are not limited, but are preferably a stack of two or more articles having a heavy weight, since the shrink wrapped package of the present invention is excellent in impact resistance at the portion of sealing and cutting and capable of tightly uniting articles. A preferred embodiment of the present invention is a shrink-wrapped package of dry batteries.

More preferably, the shrink-wrapped package of the present invention is perforated to facilitate opening. The package can be perforated using a perforating blade usually at the time of sealing and cutting. In the perforation, the length of the cuts and the length of the spaces between the cuts (hereinafter referred to as "bridges") are not limited, but the ratio of the cut length to the bridge length after shrinkage is preferably 1.5 or less, more preferably 0.7 or less. When said ratio is 1.5 or less, the package does not rupture along the perforation line even if the shrink-wrapped package is accidentally dropped.

BEST MODE FOR CARRYING OUT THE INVENTION

The present invention is described below in detail with reference to Examples.

In the Examples, the following methods were employed for property measurement and evaluation.

The intrinsic viscosity is measured by dissolving resin pellets in a solvent mixture of phenol and 1,1,2,2-tetrachloroethane (weight ratio: 1/1) at a concentration of 0.5 g/100 ml, and measuring the viscosity using an automatic capillary viscometer SS-600-L1 manufactured by Shibayama Scientific Instruments Works, Ltd.

The shrinkage percentage of the film was measured as follows: A film sample measuring 100 mm in the machine direction and 100 mm in the transverse direction was cut out from the film and dipped in a hot water at 70° C. in a thermostat water heater for 30 seconds. Then, the length in the machine direction L (mm) and the length in the transverse direction L'(mm) were measured to find the shrinkage percentage (100-L) in the machine direction (MD) and the shrinkage percentage (100-L') in the transverse direction (TD).

The impact strength of the portion of sealing and cutting was measured as follows: A complete round hole with a diameter of 3 cm was made at the center portion of a PET sheet (about 200 $\mu$m thick). A film sample was fixed on the PET sheet with adhesive cellophane tape so that the portion of sealing and cutting of the film sample was positioned at the center portion of the hole and the film sample could be punched from the surface corresponding to the internal surface of the shrink-wrapped package. The film sample was punched using an impact head (1 inch in diameter) to measure the impact strength of the portion of sealing and cutting, with a pendulum type impact tester (Toyo Seiki Co., Ltd.).

The strength of sealing was measured using a sample with a width of 10 mm, and a peel tester HEIDON-17 manufactured by Shinto Kagaku K. K., at a pulling rate of 200 mm/min.

The movement distance of the starting point of the portion of sealing and cutting was measured as follows: A 2 mm wide strip perpendicular to the seal and cut line was cut out from a shrink-wrapped package, and a microphotograph of the cross section of the portion of sealing and cutting was taken at 500×magnification (Photograph 1). Then, the strip was set on a tensile tester (Strograph) at a chuck distance of 5 cm, so that the portion of sealing and cutting was positioned at the center of the tensile tester. The strip was pulled at a rate of 50 mm/min, and pulling was stopped at the time of exceeding the yield point. Then, the strip was removed from the tester, and microphotograph of the cross section of the portion of sealing and cutting was taken in the same manner as above (Photograph 2). Subsequently, the movement distance of the starting point of the portion of sealing and cutting was found from Photographs 1 and 2, by measuring the distance between the starting point of the portion of sealing and cutting and a spot serving as a mark, such as a small ball formed by sealing, projection or depression, fine particle or foreign matter in the sealed portion shown in each of Photographs 1 and 2. (When the portion of sealing and cutting has a cross section as shown in FIG. 2, the movement distance of the starting point E or F can be measured in the same manner as above.)

The drop test was carried out as follows: A shrink-wrapped package of a stack of four AA alkaline batteries was held by a corner, and allowed to fall by its self weight from a height of 60 cm above the floor so that the opposite corner of the package struck against the floor. Ten shrink-wrapped packages were subjected to the drop test and rated as follows: A; no package ruptured, B; 1 to 9 packages ruptured, C; all the packages ruptured.

EXAMPLE 1

A polyester resin was prepared by mixing 15 parts by weight of polybutylene terephthalate (glass transition temperature: 49° C., intrinsic viscosity: 0.91 dl/g) and 85 parts by weight of an amorphous polyester resin (glass transition temperature: 81° C., intrinsic viscosity: 0.76 dl/g) comprising terephthalic acid as a dicarboxylic acid component and ethylene glycol (70 mol %) and cyclohexane dimethanol (30 mol %) as glycol components. The polyester resin was melted and extruded at 280° C. using a T die. The extruded film was orientated at 80° C. with orientation rolls 1.3 times in the machine direction. The film was preliminarily heated at 90° C. for 5 seconds, orientated at 85° C. with a tenter 4.0 times in the transverse direction, and annealed while being relaxed by 4%, giving 20 $\mu$m thick film. The shrinkage percentage of the obtained film is shown in Table 1.

Comparative Example 1

Four AA alkaline batteries were wrapped with the film obtained in Example 1 so as to allow a margin of 5% in the main shrinking direction (TD) and a margin of 4% in the direction perpendicular to the main shrinking direction (MD). Then, the film was subjected to sealing and cutting with ultrasonic waves at the central portion of the negative terminal side, to thereby obtain an pre-shrinkage package.

Figure 4:
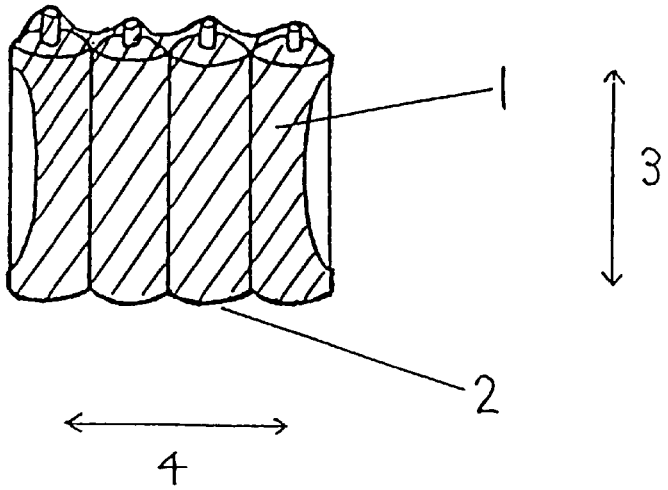
FIG. 4 is a perspective view of a shrink-wrapped package of four AA alkaline batteries having a portion of sealing and cutting at the negative terminal side.

The pre-shrinkage package was passed through a dry heat shrinking tunnel S-200 manufactured by Kyowa Denki K. K. to form a shrink-wrapped package (FIG. 4). The properties and evaluation results of the obtained package are shown in Table 1.

EXAMPLE 2

A shrink-wrapped package was prepared in the same manner as in Comparative Example 1. The vicinity of the portion of sealing and cutting of the obtained shrink-wrapped package was heated with a hot air dryer (air speed at the exit: 4 m/sec, air temperature at the exit: 300° C.) for 2 seconds to obtain a shrink-wrapped package of the present invention. The properties and evaluation results of the obtained package are shown in Table 1.

The package of Example 2 was similar in strength of sealing to that of Comparative Example 1, but remarkably different therefrom in impact strength at the sealed portion and results of the drop test. This is because, in Comparative Example 1, the movement distance of the starting point of the portion of sealing and cutting was outside the range specified in the present invention, whereas in Example 2, the movement distance was within said range.

EXAMPLE 3

A pre-shrinkage package was prepared in the same manner as in Comparative Example 1. The portion of sealing and cutting of the package was physically stretched in the direction perpendicular to the seal and cut line at a tension of 600 g/mm$^2$. Then, the package was shrunk in the same manner as in Comparative Example 1. The properties and evaluation results of the obtained package were shown in Table 1.

Comparative Example 2

A shrink-wrapped package was prepared in the same manner as in Example 3 except that the portion of sealing and cutting was stretched at a tension of 200 g/mm$^2$.

EXAMPLE 4

A polyester resin was prepared by mixing 15 parts by weight of polybutylene terephthalate (glass transition temperature: 49° C., intrinsic viscosity: 0.91 dl/g) and 85 parts by weight of an amorphous polyester resin (glass transition temperature: 63° C., intrinsic viscosity: 0.78 dl/g) comprising terephthalic acid as a dicarboxylic acid component and ethylene glycol (80 mol %), neopentyl glycol (15 mol %) and diethylene glycol (5 mol %) as glycol components. To the resulting polyester resin was added 800 ppm of PMMA fine particles (average particle diameter: 2 $\mu$m). Using the obtained mixture as a film material, a shrink-wrapped package was prepared in the same manner as in Examples 1 and 2 except that sealing and cutting was carried out using a nichrome wire. The film before preparation of the pre-shrinkage package had a thermal shrinkage percentage of 10% in MD and 24% in TD, a static friction coefficient ($\mu$s) of 0.3 and a dynamic friction coefficient ($\mu$d) of 0.4. The properties and evaluation results of the obtained package are shown in Table 1.

Comparative Example 3

A polyester resin was prepared by mixing 15 parts by weight of polybutylene terephthalate (glass transition temperature: 49° C., intrinsic viscosity: 0.91 dl/g) and 85 parts by weight of an amorphous polyester resin (glass transition temperature: 63° C., intrinsic viscosity of 0.78 dl/g) comprising terephthalic acid as a dicarboxylic acid component and ethylene glycol (80 mol %), neopenthyl glycol (15 mol %) and diethylene glycol (5 mol %) as glycol components. To the resulting polyester resin was added 800 ppm of PMMA fine particles (average particle diameter: 2 $\mu$m). Using the obtained mixture as the film material, a shrink-wrapped package was prepared in the same manner as in Example 1 and Comparative Example 1 except that sealing and cutting was carried out using a nichrome wire. The properties and evaluation results of the obtained package are shown in Table 1.

TABLE 1

| | Strength of sealing (kg/cm) | Impact resistance of portion of sealing and cutting (kg · cm) | Shrinkage percentage of film (%) MD | Shrinkage percentage of film (%) TD | Movement distance of starting point of portion of sealing and cutting ($\mu$m) | Result of drop test |
|---|---|---|---|---|---|---|
| Comp.Ex.1 | 1.20 | 2.8 | 10 | 25 | 18.6 | C |
| Ex. 2 | 1.31 | 17.2 | | | 5.9 | A |
| Ex. 3 | 1.38 | 19.6 | | | 3.4 | A |
| Comp.Ex.2 | 1.24 | 5.2 | | | 13.9 | C |
| Ex. 4 | 1.17 | 13.8 | 10 | 24 | 7.7 | A |
| Comp.Ex.3 | 1.10 | 2.9 | | | 15.2 | C |

EXAMPLE 5

A shrink-wrapped package was prepared in the same manner as in Example 4 except that the film was perforated along the machine direction at the time of sealing and cutting. The ratio of cut length to bridge length was 0.6.

In the drop test, the above obtained package was rated as "A". Further, the package could be readily torn open by hand along the perforation line.

The film used in the present invention is a polyester film containing an ethylene terephthalate unit, and thus has stiffness, good transparency and excellent shrinking properties and causes no problems with thermal disposal.

Further, when a predetermined amount of fine particles with a specific average particle diameter is added to the polyester resin containing an ethylene terephthalate unit, the resulting film is improved in lubricity without being reduced in impact strength at the portion of sealing and cutting, and thus has high amenability to high-speed automatic processing.

Moreover, the shrink-wrapped package of the invention is capable of tightly uniting articles, and has an excellent impact resistance at the portion of sealing and cutting. Accordingly, the package of the invention can be particularly preferable for shrink-wrapping a stack of articles such as dry batteries.

It is more preferable that the film is perforated to facilitate opening of the package.

What is claimed is:

1. A shrink-wrapped package comprising at least one article shrink wrapped with a polyester film containing an ethylene terephthalate unit, the shrink-wrapped package having a portion of sealing and cutting having an area of incomplete sealing and an area of complete sealing, said portion including a first starting point defined by a location of the area of incomplete sealing most remote from the area of complete sealing;

said portion made in a manner wherein when said portion has been subjected to a transverse tensile pull rate of 50 mm/min until a yield point has occurred, such that a second starting point is defined by a location on a surface of the area of complete sealing, the distance between the first and second starting points will be greater than zero but no more than 10 $\mu$m.

2. The shrink-wrapped package according to claim 1 wherein at least one surface of the polyester film has a static friction coefficient of 0.1 to 0.6 and a dynamic friction coefficient of 0.1 to 0.5.

3. The shrink-wrapped package according to claim 1 wherein the polyester film contains 3000 to 200 ppm of fine particles with an average particle diameter of 6 to 0.5 $\mu$m.

4. The shrink-wrapped package according to claim 1 wherein the article is a stack of two or more articles.

5. The shrink-wrapped package according to claim 1 wherein the article is at least one dry battery.

6. The shrink-wrapped package according to claim 1 wherein the polyester film is perforated.

* * * * *